US005226985A

United States Patent [19]

Kim et al.

[11] Patent Number: 5,226,985

[45] Date of Patent: Jul. 13, 1993

[54] METHOD TO PRODUCE GAMMA TITANIUM ALUMINIDE ARTICLES HAVING IMPROVED PROPERTIES

[75] Inventors: Young-Won Kim, Dayton; Dennis M. Dimiduk, Beavercreek, both of Ohio

[73] Assignee: The United States of America as represented by the Secretary of the Air Force, Washington, D.C.

[21] Appl. No.: 823,737

[22] Filed: Jan. 22, 1992

[51] Int. Cl.[5] ..... C22C 14/00

[52] U.S. Cl. ..... 148/671; 148/421; 148/669

[58] Field of Search ..... 148/671, 669, 421

[56] References Cited

U.S. PATENT DOCUMENTS

| | | | |
|---|---|---|---|
| 4,294,615 | 10/1981 | Blackburn et al. | 75/175.5 |
| 5,015,305 | 5/1991 | Froes et al. | 148/20.3 |
| 5,045,406 | 9/1991 | Huang | 428/614 |
| 5,076,858 | 12/1991 | Huang | 148/670 |

FOREIGN PATENT DOCUMENTS 0171862 7/1988 Japan .

OTHER PUBLICATIONS

Maeda et al, Abstract (English): Autumn Symp. Japan Inst. Metals, 1989, pp. 1–8.

Kim Jour. of Metals, Jul. 1989, p. 24.

Binary Alloy Phase Diagrams, ed. Massalski et al, ASM, 1986, p. 173

*Primary Examiner*—Upendra Roy

*Attorney, Agent, or Firm*—Charles E. Bricker; Donald J. Singer

[57] ABSTRACT

A first method for producing articles of gamma titanium alumide alloy having improved properties comprises the steps of: (a) shaping the article at a temperature between the titanium-aluminum eutectoid temperature of the alloy and the alpha-transus temperature of the alloy, and (b) aging the thus-shaped article at a temperature between about 750° and 1050° C. for about 4 to 150 hours. Shaping is preferably carried out at a temperature about 0° to 50° C. below the alpha-transus temperature.

A second method for producing articles of gamma titanium aluminide alloy having improved properties comprises the steps of: (a) shaping the article at a temperature in the approximate range of about 130° C. below the titanium-aluminum eutectoid temperature of the alloy to about 20° C. below the alpha-transus temperature of the alloy; (b) heat treating the thus-shaped article at about the alpha-transus temperature of the alloy for about 15 to 120 minutes; and (c) aging the thus-heat treated article at a temperature between about 750° and 1050° C. for about 4 to 300 hours.

6 Claims, 2 Drawing Sheets

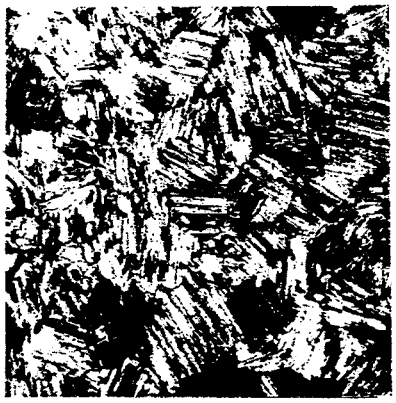
Fig. 1 150μm
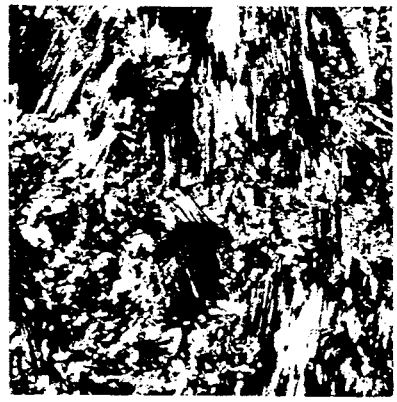
Fig. 2 50μm
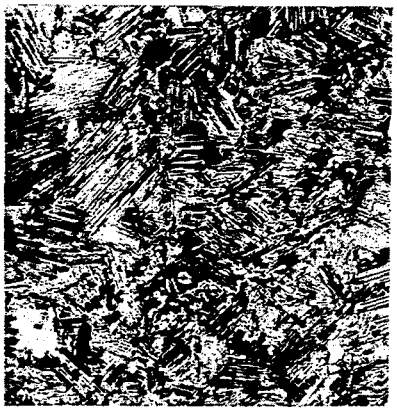
Fig. 3 100μm
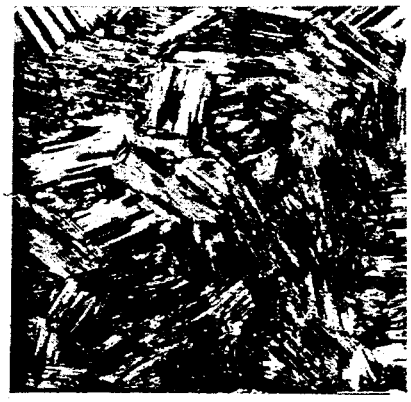
Fig. 4 150μm
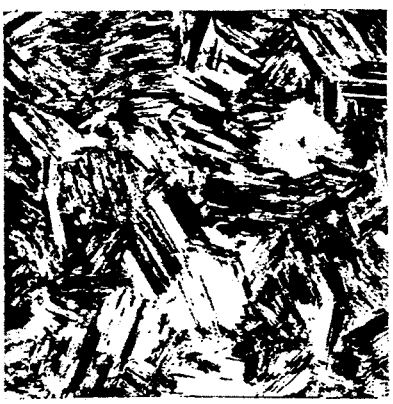
Fig. 5 150μm

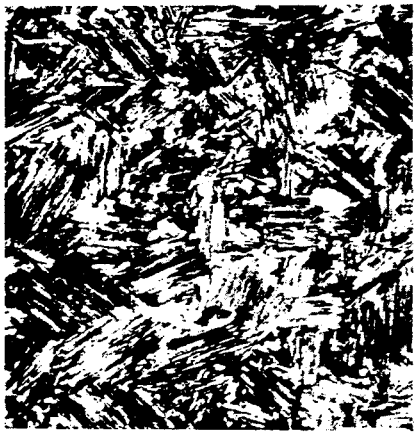
Fig. 6 150μm
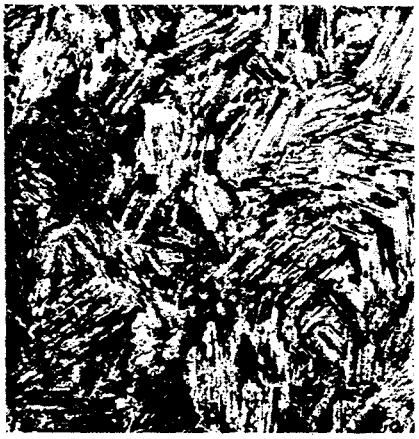
Fig. 7 50μm

METHOD TO PRODUCE GAMMA TITANIUM ALUMINIDE ARTICLES HAVING IMPROVED PROPERTIES

RIGHTS OF THE GOVERNMENT

The invention described herein may be manufactured and used by or for the Government of the United States for all governmental purposes without the payment of any royalty.

BACKGROUND OF THE INVENTION

The present invention relates to titanium alloys usable at high temperatures, particularly those of the TiAl gamma phase type. Titanium alloys have found wide use in gas turbines in recent years because of their combination of high strength and low density, but generally, their use has been limited to below 600° C., due to inadequate strength and oxidation properties. At higher temperatures, relatively dense iron, nickel, and cobalt base super-alloys have been used. However, lightweight alloys are still most desirable, as they inherently reduce stresses when used in rotating components.

Considerable work has been performed since the 1950's on lightweight titanium alloys for higher temperature use. To be useful at higher temperature, titanium alloys need the proper combination of properties. In this combination are properties such as high ductility, tensile strength, fracture toughness, elastic modulus, resistance to creep, fatigue and oxidation, and low density. Unless the material has the proper combination, it will not perform satisfactorily, and thereby the use-limited. Furthermore, the alloys must be metallurgically stable in use and be amenable to fabrication, as by casting and forging. Basically, useful high temperature titanium alloys must at least outperform those metals they are to replace in some respect, and equal them in all other respects. This criterion imposes many restraints and alloy improvements of the prior art once thought to be useful are, on closer examination, found not to be so. Typical nickel base alloys which might be replaced by a titanium alloy are INCO 718 or IN100.

Heretofore, a favored combination of elements with potential for higher temperature use has been titanium with aluminum, in particular alloys derived from the intermetallic compounds or ordered alloys $Ti_3Al$ (alpha-2) and TiAl (gamma). Laboratory work in the 1950's indicated these titanium aluminide alloys had the potential for high temperature use to about 1000° C. But subsequent engineering experience with such alloys was that, while they had the requisite high temperature strength, they had little or no ductility at room and moderate temperatures, i.e., from 20° to 550° C. Materials which are too brittle cannot be readily fabricated, nor can they withstand infrequent but inevitable minor service damage without cracking and subsequent failure. They are not useful engineering materials to replace other base alloys.

Those skilled in the art recognize that there is a substantial difference between the two ordered titanium-aluminum intermetallic compounds. Alloying and transformational behavior of $Ti_3Al$ resemble those of titanium as they have very similar hexagonal crystal structures. However, the compound TiAl has a face-centered tetragonal arrangement of atoms and thus rather different alloying characteristics. Such a distinction is often not recognized in the earlier literature. Therefore, the discussion hereafter is largely restricted to that pertinent to the invention, which is within the TiAl gamma phase realm, i.e., about 50Ti-50Al atomically and about 65Ti-35Al by weight.

Room temperature tensile ductility as high as 4% has been achieved in two-phase gamma alloys based on Ti-48Al such as Ti-48Al-(1-3)X, where X is Cr, V or Mn. This improved ductility was possible when the material was processed to have a duplex microstructure consisting of small equiaxed gamma grains and lamellar colonies/grains. Under this microstructural condition, however, other important properties including low temperature fracture toughness and elevated temperature, i.e., greater than 700° C., creep resistance are unacceptably low. Research has revealed that an all-lamellar structure dramatically improves toughness and creep resistance. Unfortunately, however, these improvements are accompanied by substantial reductions in ductility and strength. Recent experiments have shown that the improved fracture toughness and creep resistance are directly related to the features of lamellar structure, but that the large gamma grain size characteristic of fully-lamellar gamma alloys is responsible for the lowered tensile properties. These experiments have also demonstrated that the normally large grain size in fully-lamellar microstructure can be refined.

Accordingly, it is an object of the present invention to provide a method for producing articles of gamma titanium aluminide alloy which are fine grained and fully lamellar.

Other objects and advantages of the invention will be apparent to those skilled in the art.

SUMMARY OF THE INVENTION

In accordance with the invention, there is provided a method for producing articles of gamma titanium aluminide alloy having improved properties which comprises the steps of: (a) shaping the article at a temperature between the titanium-aluminum eutectoid temperature of the alloy and the alpha-transus temperature of the alloy, and (b) aging the thus-shaped article at a temperature between about 750° and 1050° C. for about 4 to 150 hours. Shaping is preferably carried out at a temperature about 0° to 50° C. below the alpha-transus temperature.

Further, in accordance with the invention, there is provided a method for producing articles of gamma titanium aluminide alloy having improved properties which comprises the steps of: (a) shaping the article at a temperature in the approximate range of about 130° C. below the titanium-aluminum eutectoid temperature of the alloy to about 20° C. below the alpha-transus temperature of the alloy; (b) heat treating the thus-shaped article at about the alpha-transus temperature of the alloy for about 15 to 120 minutes; and (c) aging the thus-heat treated article at a temperature between about 750° and 1050° C. for about 4 to 300 hours.

BRIEF DESCRIPTION OF THE DRAWING

In the drawing,

FIG. 1 is a 67× photomicrograph illustrating the lamellar structure produced by extruding Ti-48Al;

FIG. 2 is a 200× photomicrograph illustrating the lamellar structure produced by extruding Ti-46Al-2Cr-0.5Mn-0.5Mo-2.5Nb;

FIG. 3 is a 100× photomicrograph illustrating the lamellar structure produced by extruding Ti-47.5Al-2Cr-1V-0.2Ni-2Nb;

FIGS. 4 and 5 are 67× photomicrographs illustrating the lamellar structure of Ti-48Al after aging at 900° C. for 6 and 96 hours; and FIGS. 6 and 7 illustrate the fine randomly oriented lamellar structure formed after heat treatment at about the alpha transus temperature.

DETAILED DESCRIPTION OF THE INVENTION

The titanium-aluminum alloys suitable for use in the present invention are those alloys containing about 40 to 50 atomic percent Al (about 27 to 36 wt. %), balance Ti. The methods of this invention are applicable to the entire composition range of two-phase gamma alloys which can be formulated as:

Binaries: Ti-(45-49)Al (at %);

Multi-component alloys: Ti-(46-49)Al-(1-3)X-(2-6)Y, where X is Cr, V, Mn, W or any combination thereof, and Y is Nb, Ta or any combination thereof (at %);

Above alloys with additions of small amounts (0.05–2.0 at %) of Si, B,

P, Se, Te, Ni, Fe, Ce, Er, Y, Ru, Sc or Sn, or any combination thereof. Examples of suitable alloy compositions include Ti-46Al-2Cr-0.5Mn-0.5Mo-2.5Nb (at %), Ti-47.5Al-2Cr-1V-0.2Ni-2Nb (at %), Ti-47.3Al-1.5Cr-0.4Mn-0.5Si-2Nb (at %), Ti-47Al-1.6Cr-0.9V-2.3Nb (at %), Ti-47Al-1Cr-4Nb-1Si (at %) and Ti-(46-48)Al (at %). The starting materials are alloy ingots or consolidated powder billets, preferably in the hot isostatically pressed (HIP'd) condition.

The first method disclosed above is hereinafter referred to as a thermomechanical process (TMP) and comprises shaping the article by extrusion or hot die forging, rolling or swaging, followed by a stabilization aging treatment. Where shaping is by extrusion, extrusion is carried out at a temperature in the approximate range of 0° to 20° C. below the alpha-transus temperature of the alloy. The alpha-transus temperature ($T_\alpha$) ranges from about 1340° to about 1400° C., depending on the alloy composition. $T_\alpha$ can be determined with sufficient accuracy by differential thermal analysis (DTA) and metallographic examinations. Extrusion parameters suitable for producing the desired microstructure include extrusion ratios between 4:1 and 16:1, and extrusion rates between 1 cm/sec and 2 cm/sec. The aging temperature can range between 750° and 1050° C., depending on the specific use temperature contemplated. Aging time should be at least 1, preferably 4, hours and can be up to 300 hours or as long as possible; however, 100 hours appears to be adequate.

Where shaping is by hot die forging, rolling or swaging, such shaping is carried out at a temperature in the approximate range of 50° C. above $T_e$, the eutectoid temperature of two-phase gamma alloys (≈1130° C.), to $T_\alpha$, preferably about 0° to 20° C. below $T_\alpha$, at a reduction of at least 50% and a rate of about 5–20 mm/min.

The second method disclosed above is hereinafter referred to as a thermomechanical treatment (TMT), which comprises hot working at temperatures well below the alpha-transus ($T_\alpha$) with subsequent heat treatment near the alpha-transus, followed by a stabilization aging treatment. In accordance with this method, the article may be shaped by extrusion, rolling, isothermal forging or hot die forging.

Where shaping is by extrusion, extrusion is carried out at a temperature in the approximate range of $T_e$-130° C. to $T_\alpha$-20° C. Extrusion parameters suitable for producing the desired microstructure include extrusion ratios between 4:1 and 16:1, and extrusion rates between 1 cm/sec and 2 cm/sec.

Where shaping is by hot die forging, rolling or swaging, such shaping is carried out at a temperature in the approximate range of $T_e-130°$ C. to $T_\alpha-20°$ C., at a reduction of at least 50% and a rate of about 5–20 mm/min. Where shaping is by isothermal forging, such shaping is carried out at a temperature in the approximate range of $T_e-130°$ C. to $T_e+100°$ C., at a reduction of at least 60% and a rate of about 2–7 mm/min.

After hot working, the article is heat treated at a temperature in the approximate range of $T_\alpha-5°$ C. to $T_\alpha+20°$ C. for about 15 to 120 minutes. The article should be heated to heat treatment temperature at a rate of at least about 200° C./minute. Following such heat treatment, the article is cooled at a rate of about 30° to 500° C./minute. The article may be cooled to ambient temperature or, alternatively, to the intended temperature for aging.

The aging temperature can range between 750° and 1050° C., depending on the specific use temperature contemplated. Aging time should be at least 1, preferably 4, hours and can be as long as possible; however, 300 hours appears to be adequate.

The following examples illustrate the invention. In the examples, the alloys used are identified as follows:

| Designator | Composition | $T_\alpha$ |
|---|---|---|
| Binary | Ti—48Al | 1380° C. |
| G3 | Ti—46Al—2Cr—0.5Mn—0.5Mo—2.5Nb | 1330° C. |
| G5 | Ti—47.5Al—2Cr—1V—0.2Ni—2Nb | 1340° C. |
| G8 | Ti—47Al—1.6Cr—0.9V—2.3Nb | 1365° C. |
| G9 | Ti—47Al—1Cr—4Nb—1Si | 1362° C. |

EXAMPLE I

Thermomechanical Process (TMP)

The alloys designated above as Binary, G3 and G5 were extruded at 1330°, 1335° and 1335° C., respectively, at an extrusion ratio of 6:1. FIGS. 1–3 illustrate the fine lamellar microstructures produced by extruding these alloys. The lamellar microstructures were then aged to stabilize the microstructures at use temperatures. FIGS. 4 and 5 illustrate the TMP microstructures of the Binary alloy after aging at 900° C. for 6 hours (FIG. 4) and 96 hours (FIG. 5). Comparison of FIGS. 4 and 5 with FIG. 1 reveals no visible changes by the aging.

EXAMPLE II

Thermomechanical Treatment (TMT)

The alloys designated as G3, G5, G8 and G9 were hot forged at 85% reduction, heat treated and aged. FIG. 6 illustrates the fine, randomly oriented lamellar structure formed after heat treatment of alloy G8 at 1370° C. for 1 hour. FIG. 7 illustrates the fine, randomly oriented lamellar structure formed after treatment of alloy G9 at 1380° C. for 1 hour. The tensile properties of alloys G3, G5 and G9 are shown in Table I, below. The term RT means ambient temperature. For comparison, the RT, as-cast elongation is also shown.

TABLE I

| Alloy | Test Temp., °C. | YS, ksi | UTS, ksi | Modulus, msi | El., % | As-Cast El., % |
|---|---|---|---|---|---|---|
| G3 | RT | 101 | 110 | 25.0 | 1.2 | 0.4–0.5 |

TABLE I-continued

| Alloy | Test Temp., °C. | YS, ksi | UTS, ksi | Modulus, msi | El., % | As-Cast El., % |
|---|---|---|---|---|---|---|
| | 1000 | 32 | 37 | 5.2 | >30.0 | |
| G5 | RT | 83 | 93 | 24.0 | 2.0 | ≈0.5 |
| | 1000 | 32 | 36 | 4.8 | >40.0 | |
| G9 | RT | 82 | 94 | 25.5 | 1.6 | ≈0.5 |
| | 1000 | 33 | 37 | 8.2 | >30.0 | |

Examination of the data in Table I reveals the pronounced increase in RT elongation provided by the method of this invention.

Various modifications may be made to the invention as described without departing from the spirit of the invention or the scope of the appended claims.

We claim:

1. A method for producing articles of gamma titanium aluminide alloy having improved properties which comprises the steps of:

(a) shaping said article at a temperature in the approximate range of about 130° C. below the titanium-aluminum eutectoid temperature of said alloy to about 20° C. below the alpha-transus temperature of said alloy;

(b) heat treating the thus-shaped article at about the alpha-transus temperature of said alloy for about 15 to 120 minutes;

(c) cooling the heat-treated article at a rate of about 30° to 500° C. per minute; and (d) aging the article at a temperature between about 750° and 1050° C. for about 4 to 300 hours.

2. The method of claim 1 wherein said article is shaped by extrusion at a temperature in the approximate range of 130° C. below said titanium-aluminum eutectoid to about 20° C. below said alpha-transus.

3. The method of claim 1 wherein said article is shaped by isothermal forging at a temperature in the approximate range of 130° C. below said titanium-aluminum eutectoid to about 100° C. above said eutectoid.

4. The method of claim 1 wherein said article is shaped by hot die forging at a temperature in the approximate range of 130° C. below said titanium-aluminum eutectoid to about 20° C. below said alpha-transus.

5. The method of claim 1 wherein said heat treatment step (b) is carried out at a temperature about 5° below to 20° C. above said alpha-transus.

6. A method for producing extruded articles of gamma titanium aluminide alloy having improved properties which comprises the steps of:

(a) extruding said article at a temperature in the approximate range of 0° to 20° C. below the alpha-transus temperature of said alloy, at an extrusion ratio of about 4:1 to 16:1 and an extrusion rate of about 1-2 cm/second, and (b) aging the thus-extruded article at a temperature between about 750° and 1050° C. for about 4 to 300 hours.

* * * * *